US008011329B2

(12) United States Patent
Hardy

(10) Patent No.: US 8,011,329 B2
(45) Date of Patent: Sep. 6, 2011

(54) AUTOMATICALLY CONTROLLED OUTDOOR PELLETIZED BIO-FUEL-BURNING HYDRONIC HEATER

(76) Inventor: Willie J. Hardy, Philadelphia, MS (US)

( * ) Notice: Subject to any disclaimer, the term of this patent is extended or adjusted under 35 U.S.C. 154(b) by 649 days.

(21) Appl. No.: 12/219,124

(22) Filed: Jul. 16, 2008

(65) Prior Publication Data

US 2009/0025654 A1 Jan. 29, 2009

Related U.S. Application Data

(60) Provisional application No. 60/929,931, filed on Jul. 18, 2007.

(51) Int. Cl.
*F24D 3/08* (2006.01)

(52) U.S. Cl. ..... 122/16.1; 237/8 A; 237/19; 122/22

(58) Field of Classification Search ..... 122/16.1, 122/18.1, 18.3, 18.31, 22, 58 FB, 90, 91; 237/2 A, 8 A, 8 B, 18, 19
See application file for complete search history.

(56) References Cited

U.S. PATENT DOCUMENTS 1,178,704 A * 4/1916 Berry ..... 110/204
4,360,003 A 11/1982 Hardy
4,393,814 A * 7/1983 Sievert ..... 122/22
4,479,605 A * 10/1984 Billotte et al. ..... 237/8 R
4,724,798 A * 2/1988 Alspaugh ..... 122/14.2
4,779,795 A * 10/1988 Winmill ..... 237/8 R
6,202,935 B1 * 3/2001 Akkala et al. ..... 237/19
2010/0180835 A1 * 7/2010 Ungaro ..... 122/16.1
2010/0251973 A1 * 10/2010 Dongo et al. ..... 122/14.1

* cited by examiner

*Primary Examiner* — Gregory A Wilson
(74) *Attorney, Agent, or Firm* — Jacobson Holman PLLC

(57) ABSTRACT

A heating system has a heating unit with a combustion chamber for burning wood pellets or other pelletized fuel. The heating unit is controlled by a process control module that automatically keeps all operating functions within predetermined limits for safe, efficient and easy operation. The unit also includes a combustion air distribution assembly with a stir shaft that rotates within the combustion chamber and introduces combustion air through orifices along the length of the shaft to enhance fuel combustion. A thermo cycle plumbing assembly serves as a safety feature by preventing overheating in the event of a power failure or pump failure. Also included in the unit is a removable insulated firebox burn chamber that provides a high temperature combustion atmosphere and a heat/particulate recovery module which provides maximum heating efficiency and reduces emissions, meeting EPA requirements and contributing to a cleaner environment.

18 Claims, 12 Drawing Sheets

AUTOMATICALLY CONTROLLED OUTDOOR PELLETIZED BIO-FUEL-BURNING HYDRONIC HEATER

This application is entitled to and hereby claims the priority of U.S. provisional application, Ser. No. 60/929,931, filed Jul. 18, 2007.

BACKGROUND OF THE INVENTION

1. Field of the Invention

The present invention is related to the field of wood burning heaters and, more particularly, to an automatically controlled outdoor heating unit that uses wood pellets or other pelletized fuel.

2. Description of the Related Art

Free standing outdoor wood burning heaters have been available for a number of years. The heater set forth by the present inventor in U.S. Pat. No. 4,360,003 uses wood logs or sections thereof as fuel and has a combustion chamber to burn the wood. The heat generated by the burning wood is transferred to water in a tank that substantially surrounds the combustion chamber. The hot water is then utilized for household use or to provide heat for a home heating system.

With the availability of a wider range of pelletized fuels in recent years, as well as advances in control systems, a need exists for an improved heating unit that is able to utilize these pelletized fuels and provide improved performance features through the use of an automatic control system. A further need is for a unit that is more environmentally friendly by virtue of its use of a by-product or waste product as fuel and also by its greater ability of particulate recovery resulting in significantly reduced emissions.

SUMMARY OF THE INVENTION

In view of the foregoing, the present invention is directed to a heating system having a heating unit with a combustion chamber for burning wood pellets or other pelletized material as fuel. Heat from the combustion chamber is transferred to water in a water tank that substantially surrounds the combustion and related recovery chambers to provide hot water for household purposes or heat for a home heating system.

The heating unit is controlled by a process control module that is programmable to keep all operating functions within predetermined limits for safe, efficient and easy operation. With this control module, the operation of the heating unit is automatic, including the rates at which fuel and combustion air are introduced into the combustion chamber.

The heating unit further includes a combustion air distribution assembly having a stir shaft that rotates within the combustion chamber and introduces combustion air through orifices along the length of the shaft to optimize combustion of the fuel. The shaft is mounted within a removable insulated firebox burn chamber that provides a high temperature combustion atmosphere and is insulated sufficiently to maintain the heat necessary for a re-firing with minimal emissions produced when the unit cycles on.

A heat/particulate recovery module having a heat exchanger assembly with a plurality of heat recovery plates in spaced vertical relationship is placed in the combustion chamber directly over the firebox. The plates take off the heat generated by the combustion chamber and are filled with a liquid, preferably water, which is pumped to the lowermost plate and then moves to the remaining recovery plates and finally into a water tank. The recovery module also serves to remove emission particulates from the burned fuel by slowing the exhaust gases to a velocity so that the particulates will accumulate onto the top of the water-filled heat recovery plates and are not exhausted into the atmosphere.

A safety mechanism is also provided in the form of a thermo cycle plumbing assembly. Whenever a power failure or a pump failure occurs, the heat recovery module will continue to operate without overheating. The physics by which hot water taken from the coldest portion of the water tank rises through the heat recovery module to the upper and hottest portion of the tank and is fed through the thermo cycle plumbing assembly provides an effective safety feature.

In accordance with the foregoing, one object of the present invention is to provide an outdoor heating unit with a combustion chamber that uses wood pellets or other pelletized fuel as the heat source.

Another object of the present invention is to provide an outdoor heating unit controlled by a process control module so that operation of the unit is automatic, including the rates at which fuel and combustion air are introduced into the firebox burn chamber.

A further object of the present invention is to provide an outdoor heating unit that has a specially designed combustion air distribution assembly with a stir shaft that rotates in the combustion chamber and introduces combustion air through orifices along the length of the shaft to optimize combustion of the fuel.

Still another object of the present invention is to provide an outdoor heating unit having a specially designed, removable insulated firebox burn chamber that provides a high temperature combustion atmosphere and is insulated sufficiently to maintain the heat necessary for a re-firing with minimal emissions produced when the unit cycles on.

A still further object of the present invention is to provide an outdoor heating unit having a heat/particulate recovery module consisting of a heat exchanger assembly placed in the firebox that provides additional heat transfer above the combustion chamber for maximum heating efficiency while also slowing the exhaust gases to a velocity at which the particulates accumulate in the recovery module and are not exhausted into the atmosphere.

Yet another object of the present invention is to provide an outdoor heating unit which includes a safety mechanism in the form of a thermo cycle plumbing assembly that ensures that whenever a power failure or a pump failure occurs, the heat recovery module will continue to operate without overheating.

A still yet further object of the present invention is to provide a heating unit with automatic operation that provides the consumer with safety, efficiency and convenience.

Still yet another object of the present invention is to provide a heating unit that is not complex in structure and which can be manufactured at a reasonable cost but yet efficiently combusts a range of relatively inexpensive renewable energy sources to provide a cost-efficient and environmentally friendly hot water for home use.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
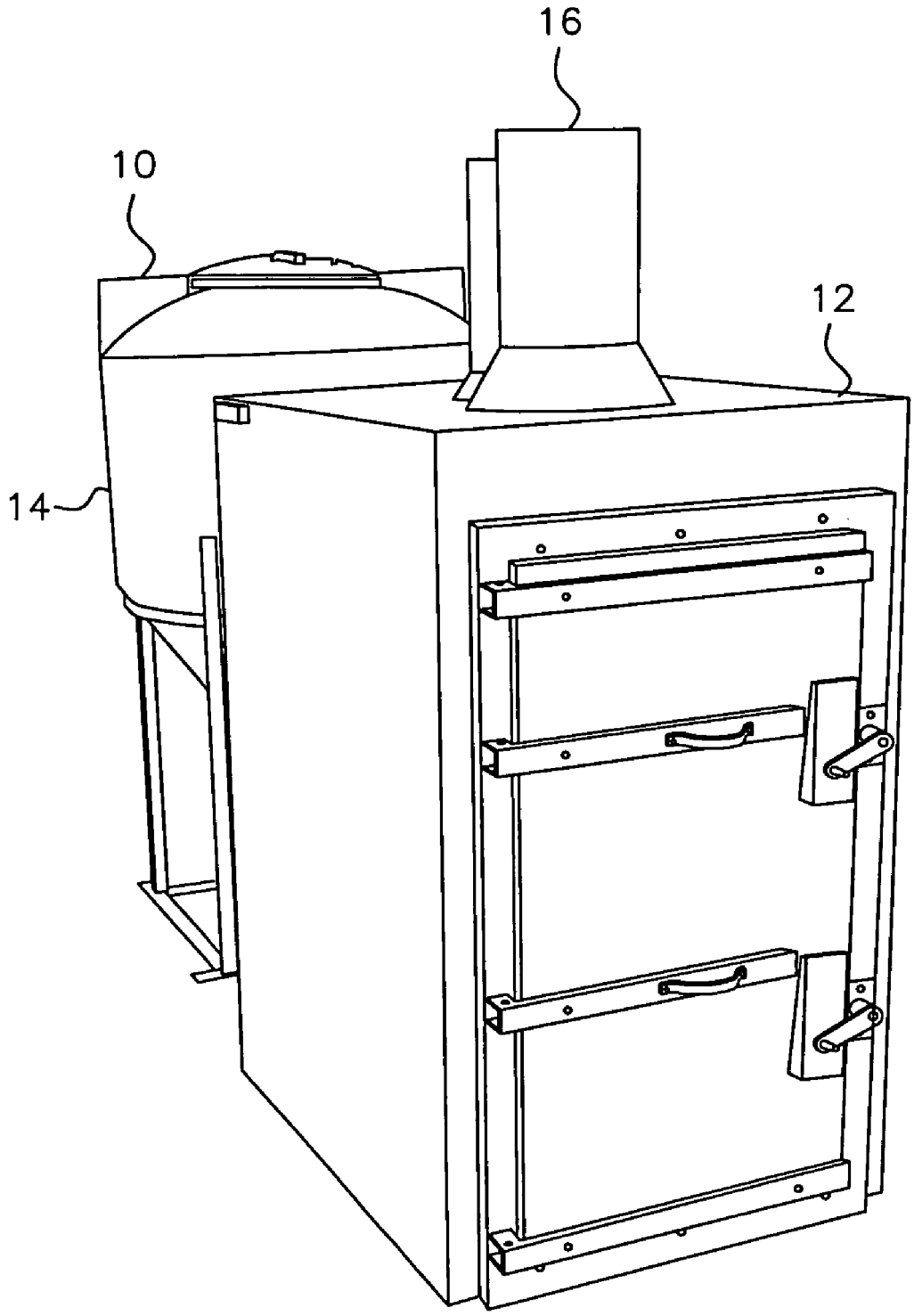
FIG. 1 is a perspective view of an automatically controlled outdoor pelletized bio-fuel burning hydronic heating unit and fuel storage bin system in accordance with the present invention.
Figure 2:
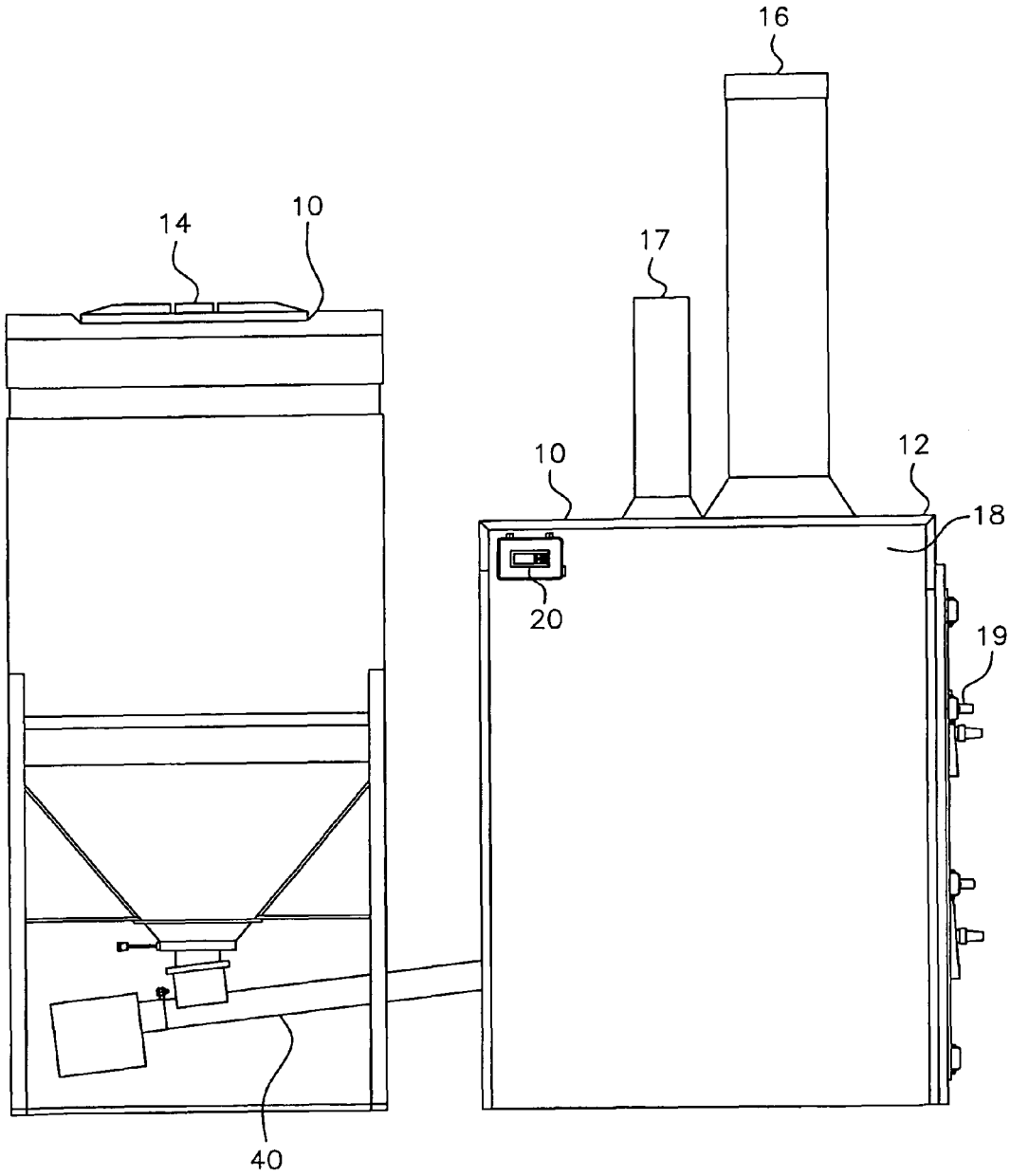
FIG. 2 is a left side view of the heating unit and fuel storage bin of FIG. 1.
Figure 3:
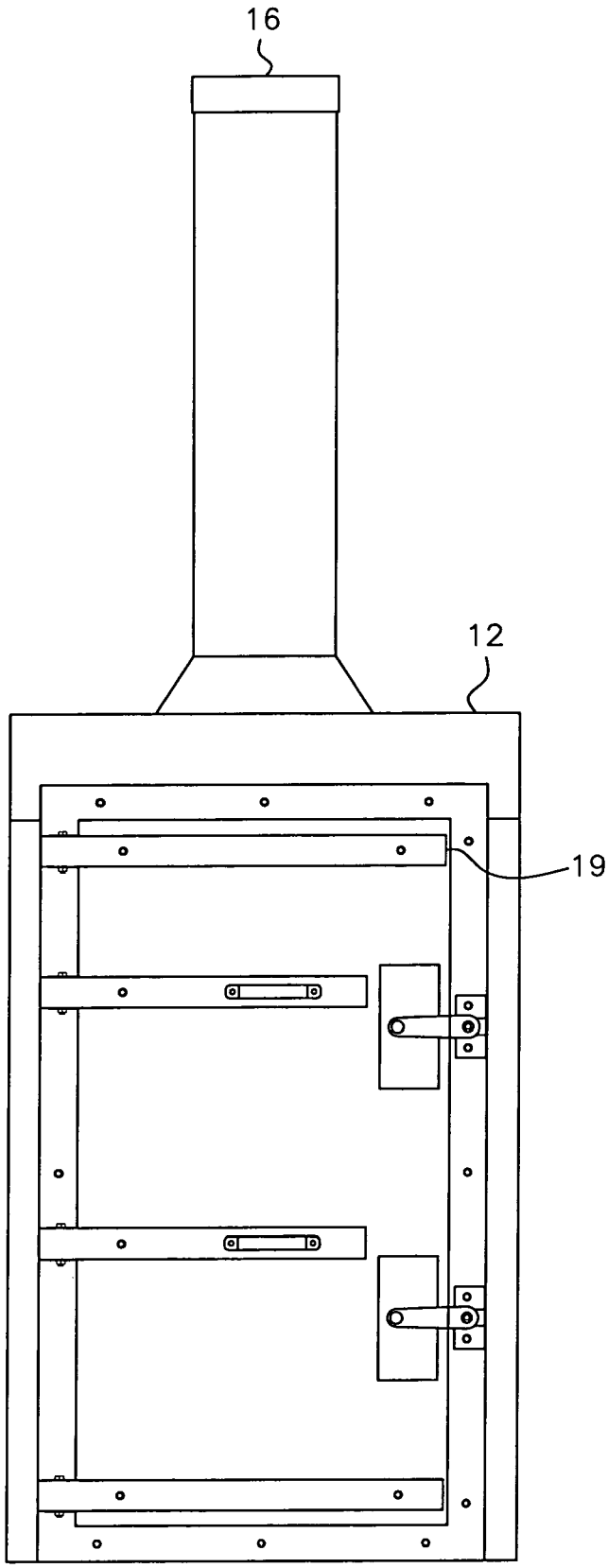
FIG. 3 is a front view of the heating unit of FIG. 1.
Figure 4:
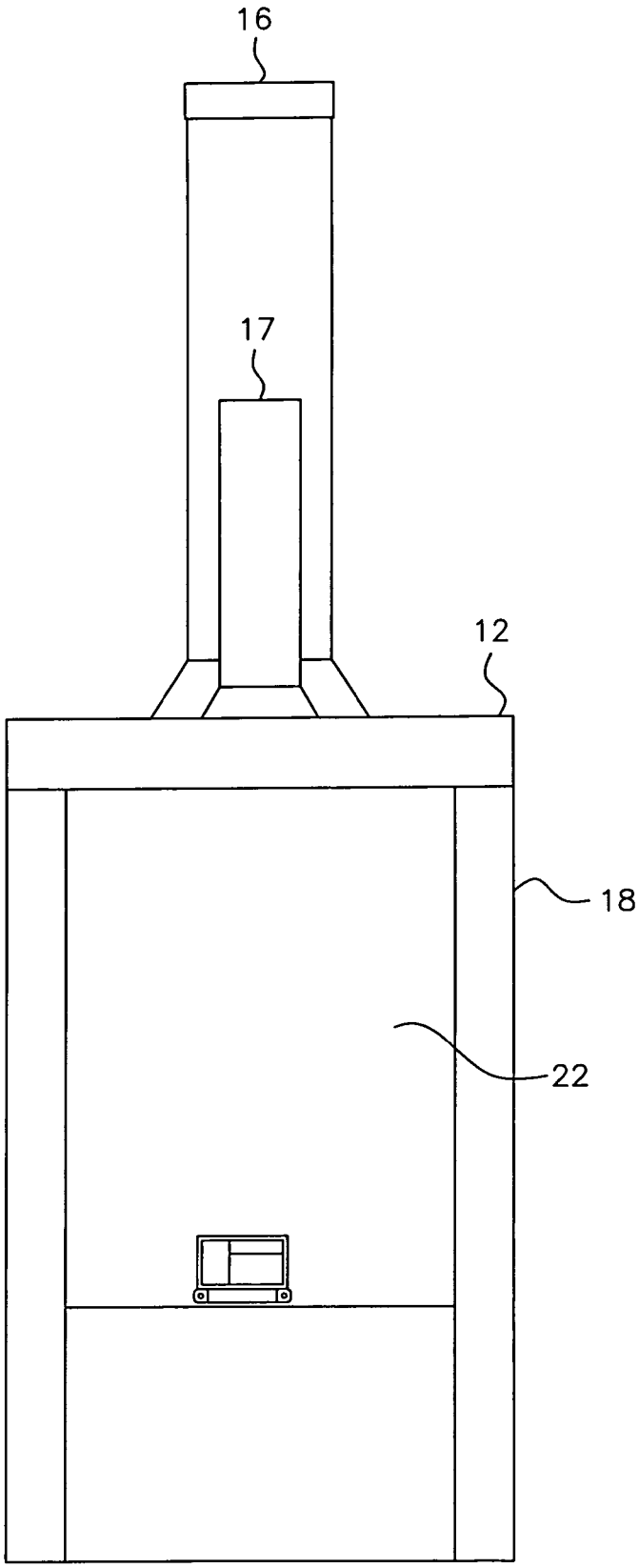
FIG. 4 is a rear view of the heating unit of FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As shown in FIGS. 1-4, the present invention is directed to an automatically controlled outdoor pelletized bio-fuel burning hydronic heating unit and fuel storage bin system generally designated by reference numeral 10. The system 10 includes a heating unit generally designated by reference numeral 12 and a fuel storage bin generally designated by reference numeral 14. The heating unit 12 releases exhaust to the environment through a smoke stack 16 and is enclosed within an outdoor weather-resistant insulated housing 18 that contains a combustion chamber generally designated by reference numeral 30.

Access to the interior of the combustion chamber 30 is provided through an access door 19 on the front of the heating unit 12. Access to the interior of the plumbing and electrical housing 18 is provided through an access door 22 on the rear of the heating unit. Accessible from outside the housing is a process control module 20 (see FIG. 2) by which the heating unit 12 may be programmed and controlled. As a non-pressurized hydronic heater, the condenser stack 17 condenses the steam generated when the water is heated and returns the condensate to the water tank 31. This prevents excess water use.

Figure 5:
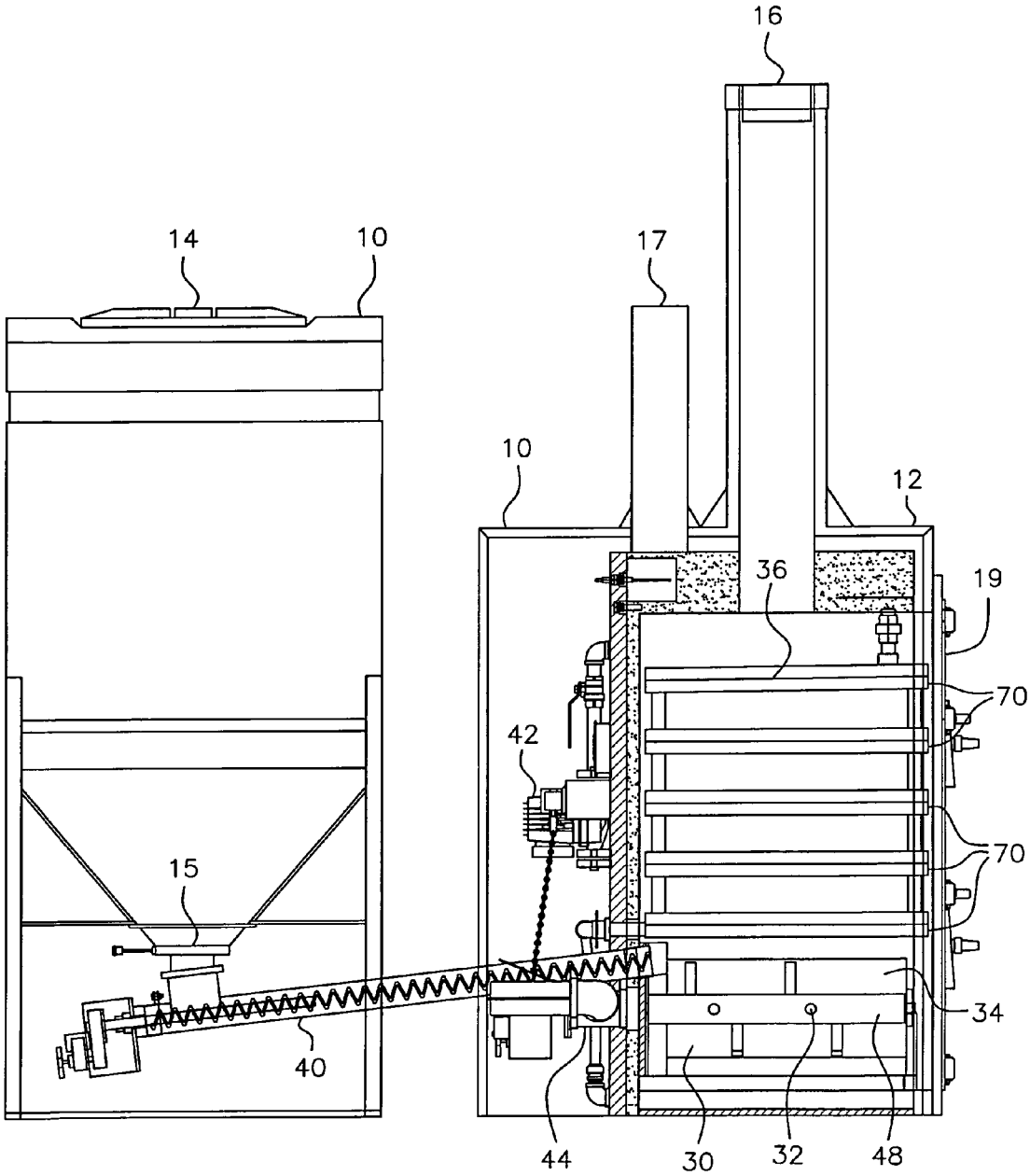
FIG. 5 is a cutaway side view of the heating unit and fuel storage bin as shown in FIG. 2, showing the combustion chamber with firebox burn chamber, combustion air distribution assembly, and heat/particulate recovery module.
Figure 6:
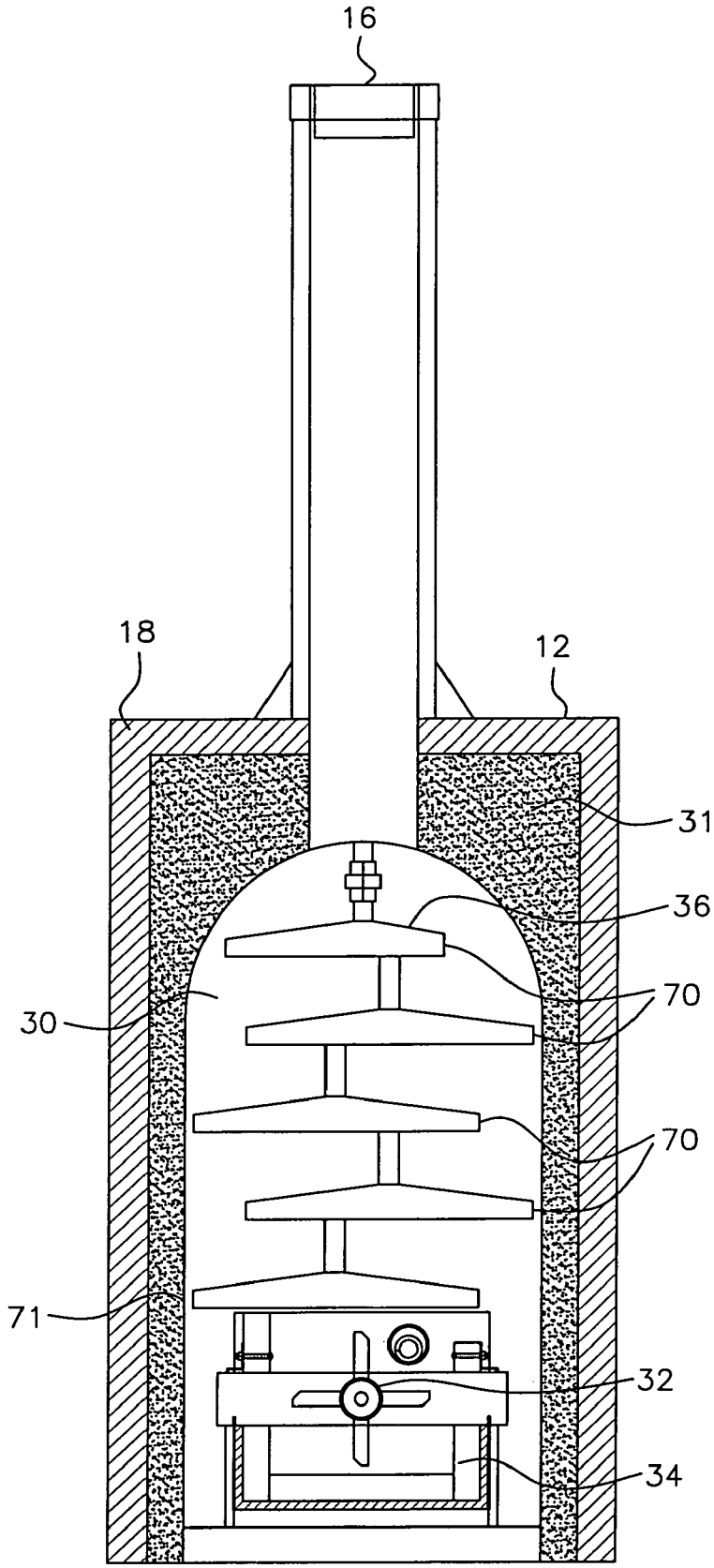
FIG. 6 is a cutaway front view of the heating unit as shown in FIG. 3, showing the firebox burn chamber and heat/particulate recovery module.

As shown in FIGS. 5, 6, 7A and 7B, the combustion chamber 30 contains an insulated firebox burn chamber 34 having a combustion air distribution assembly, generally designated by reference numeral 32, mounted therein. A heat/particulate recovery module generally designated by reference numeral 36, shown in isolation in FIGS. 8A and 8B, is mounted inside the combustion chamber 30 above the firebox burn chamber 34 as shown in FIGS. 5 and 6. Heat from the combustion chamber 30 is transferred to a water tank 31 that substantially surrounds the combustion chamber 30 to provide hot water for household purposes or heat for a home heating system.

Figure 9:
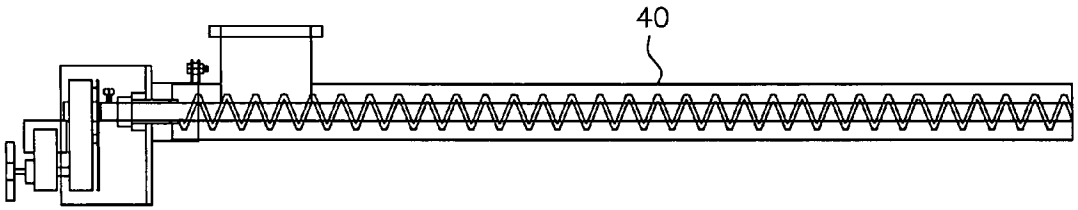
FIG. 9 is an isolated view of the feed auger assembly of FIG. 5.

A fuel auger assembly generally designated by reference numeral 40, shown in isolation in FIG. 9, augers pelletized fuel flowing by gravity from the bottom 15 of the fuel storage bin 14 into the firebox burn chamber 34 where the fuel is ignited and the combustion process begins. To assist in combustion, a combustion air blower assembly generally designated by reference numeral 42, shown in FIGS. 5 and 10, directs a flow of air into a combustion air/power transmission device 44 coupled to the combustion air distribution assembly 32.

Figure 11:
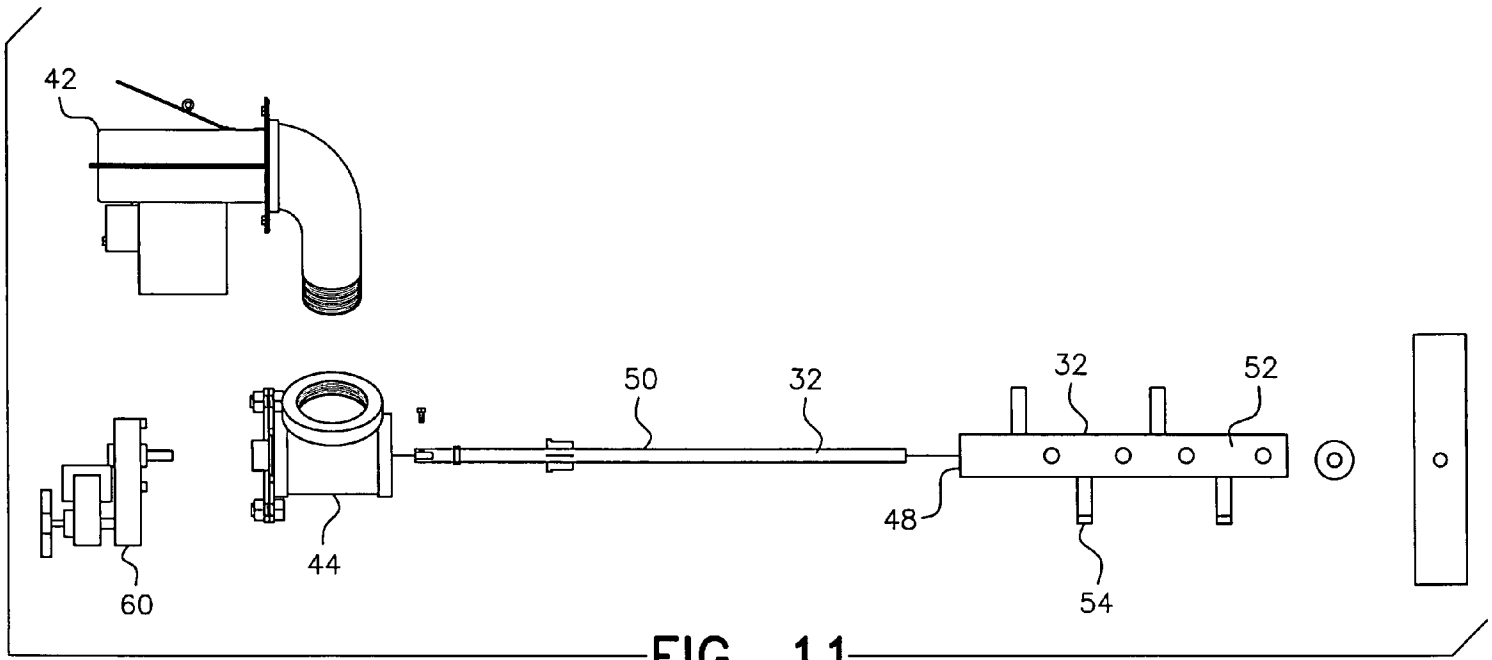
FIG. 11 is an isolated, exploded view of the combustion air distribution assembly.

The combustion air distribution assembly 32, shown in exploded view in FIG. 11, includes a stir shaft generally designated by reference numeral 48 having an insert rod 50 and a sleeve 52 that runs the length of the removable firebox 34. The sleeve 52 is provided with a plurality of orifices 54 along its length through which combustion air is blown. A stir shaft drive assembly, generally designated by reference numeral 60, attached to the combustion air/power transmission device 44 rotates the stir shaft 48 within the firebox burn chamber 34 so that combustion air being blown into the chamber through the stir shaft orifices 54 is distributed throughout the firebox burn chamber 34 to provide complete combustion of the fuel. Preferably, the stir shaft 48 is easily removable for maintenance convenience.

Figure 7A:
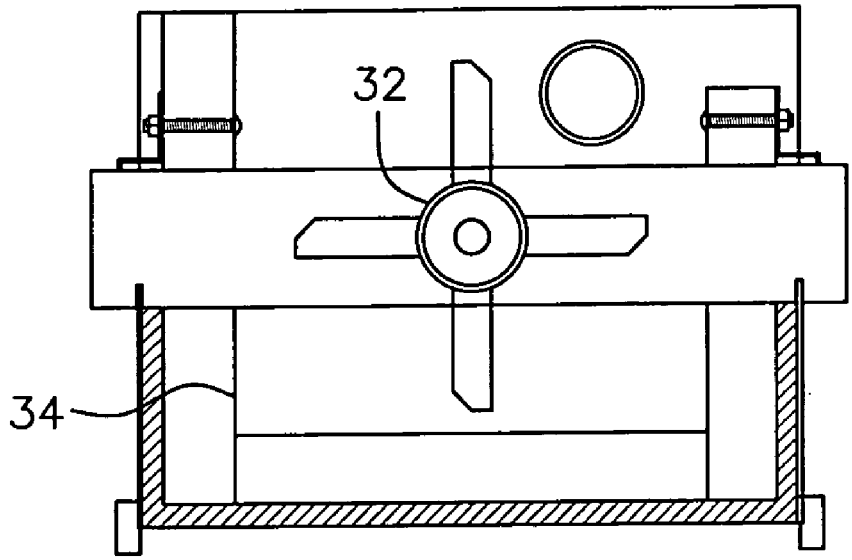
FIG. 7A is an end view of the firebox burn chamber and combustion air distribution assembly of the heating unit as shown in FIG. 5.
Figure 7B:
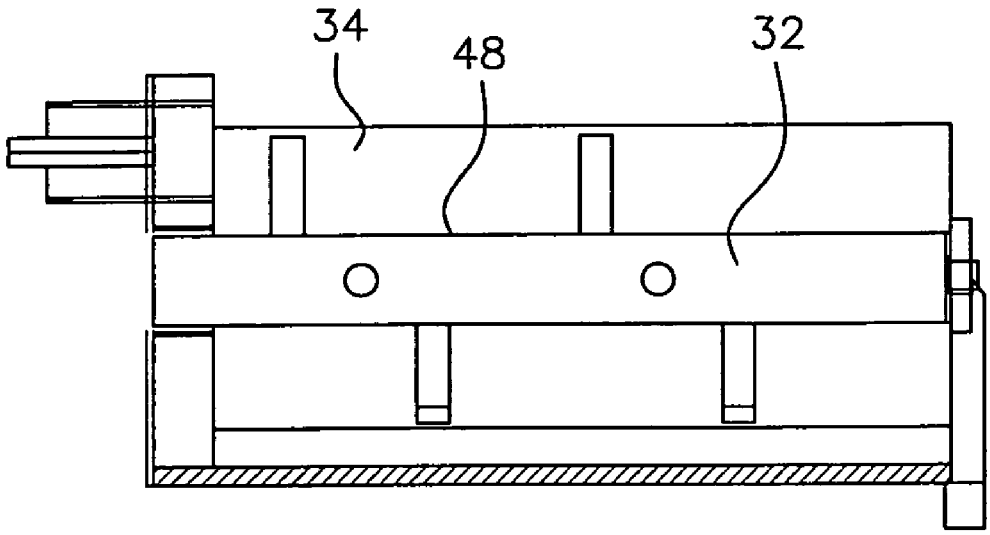
FIG. 7B is a side view of the firebox burn chamber and combustion air distribution assembly as shown in FIG. 7A.
Figure 8A:
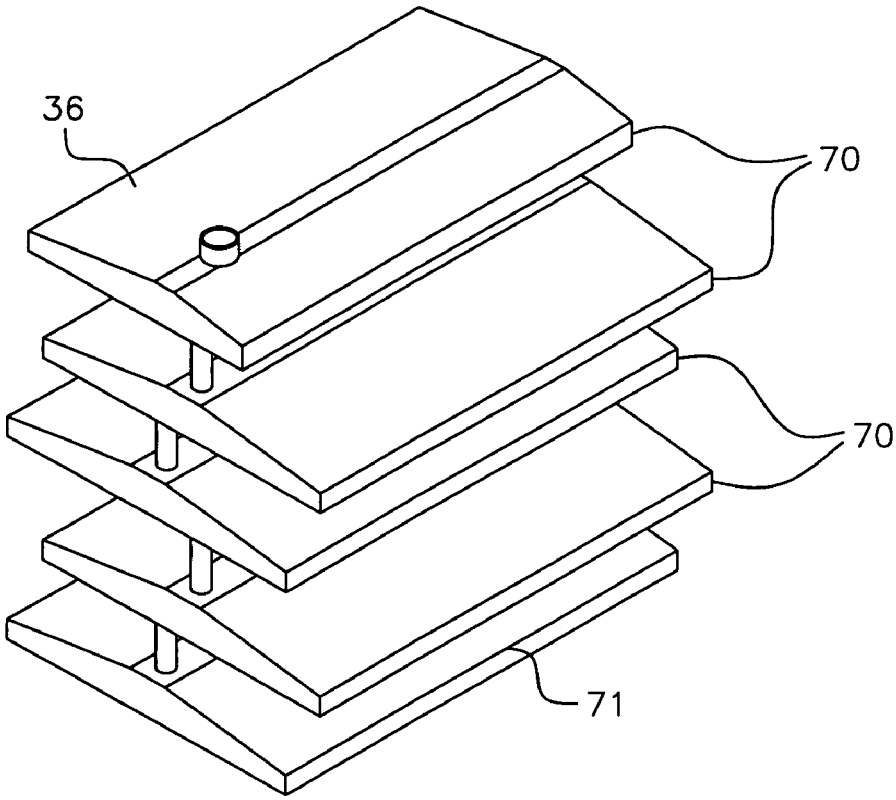
FIG. 8A is a perspective view of the heat/particulate recovery module of FIG. 5.
Figure 8B:
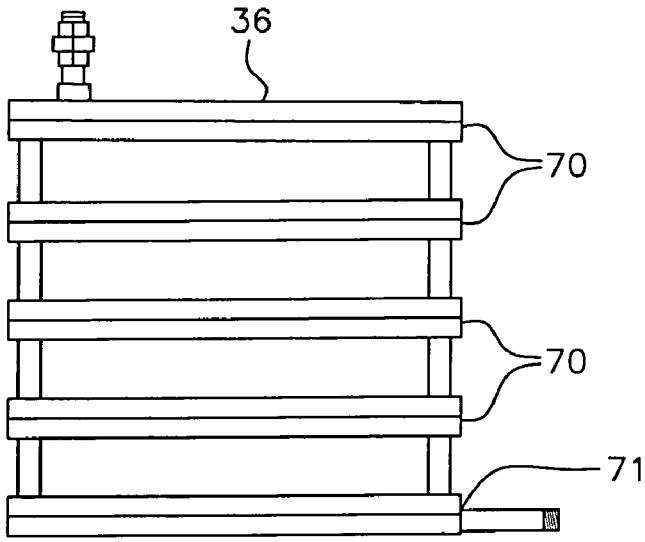
FIG. 8B is a side view of the heat/particulate recovery module of FIG. 8A.

The insulated firebox burn chamber 34 shown in FIGS. 7A and 7B provides a high temperature combustion atmosphere and is sufficiently insulated to maintain the heat necessary to reinitiate combustion when the unit cycles on while, at the same time, producing minimal emissions. Like the stir shaft 48, the firebox is also preferably easily removable for maintenance ease.

The heat/particulate recovery module 36 includes a heat exchanger assembly having a plurality of water-filled heat recovery plates 70 mounted vertically within the combustion chamber 30 as shown in FIGS. 5 and 6. In the preferred embodiment shown, there are five heat recovery plates 70, although a greater or fewer number of such plates may also be used. Water is pumped by a circulating pump 88 from the heated location of the lowermost water-filled heat recovery plate 71 into the remaining recovery plates, four in this instance, and finally into a water tank 31 from which the heated water is directed to a heated location through a water supply line 87. After passing through the heated location, a baseboard home heating system, for example, the water returns to the heating unit through a water line 85 and water return 81.

The heat/particulate recovery module 36 has two functions. First, with the lowermost heat recovery plate 71 directly over the combusting fuel and the remaining plates 70 in spaced relationship thereto to systematically absorb the heat being generated, the module 36 provides additional heat transfer from the combustion chamber 30 for maximum heating efficiency. Second, the heat/particulate recovery module 36 removes emission particulates from the burned fuel by slowing the exhaust gases to a velocity at which the particulates will "fall out" of the air flow and accumulate onto the tops of the recovery plates rather than being exhausted into the atmosphere through the smoke stack 16.

Figure 10:
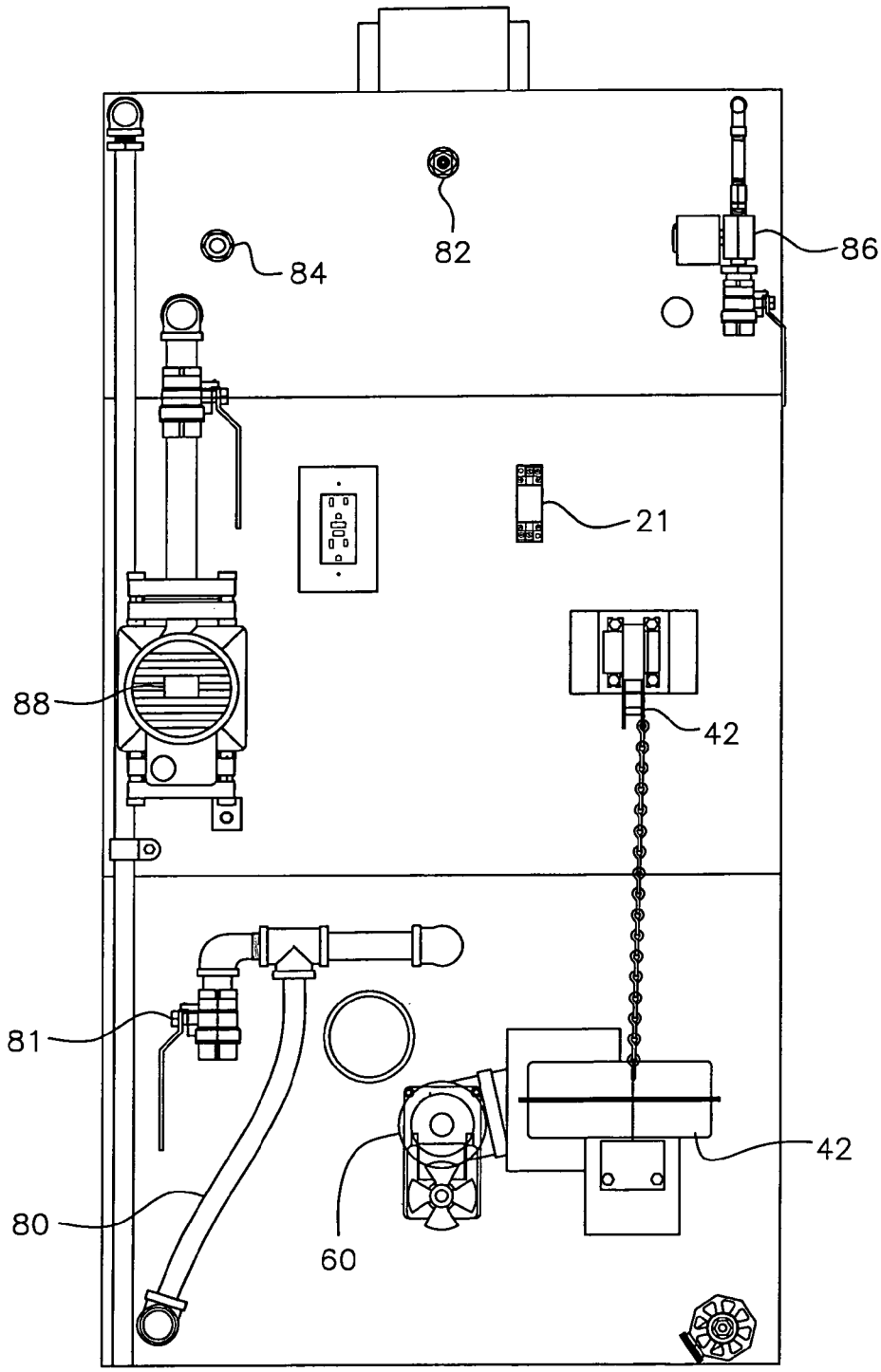
FIG. 10 is a rear view of the heating unit of FIG. 1, shown with the housing removed.

The present invention further includes a safety feature in the form of a thermo cycle plumbing assembly generally designated by reference numeral 80, shown in FIG. 10. Whenever a power failure or a pump failure occurs, the thermo cycle plumbing assembly 80 enables the heat/particulate recovery module 36 to continue to operate without overheating. This continued operation is made possible by the physics of hot water rising.

Figure 12A:
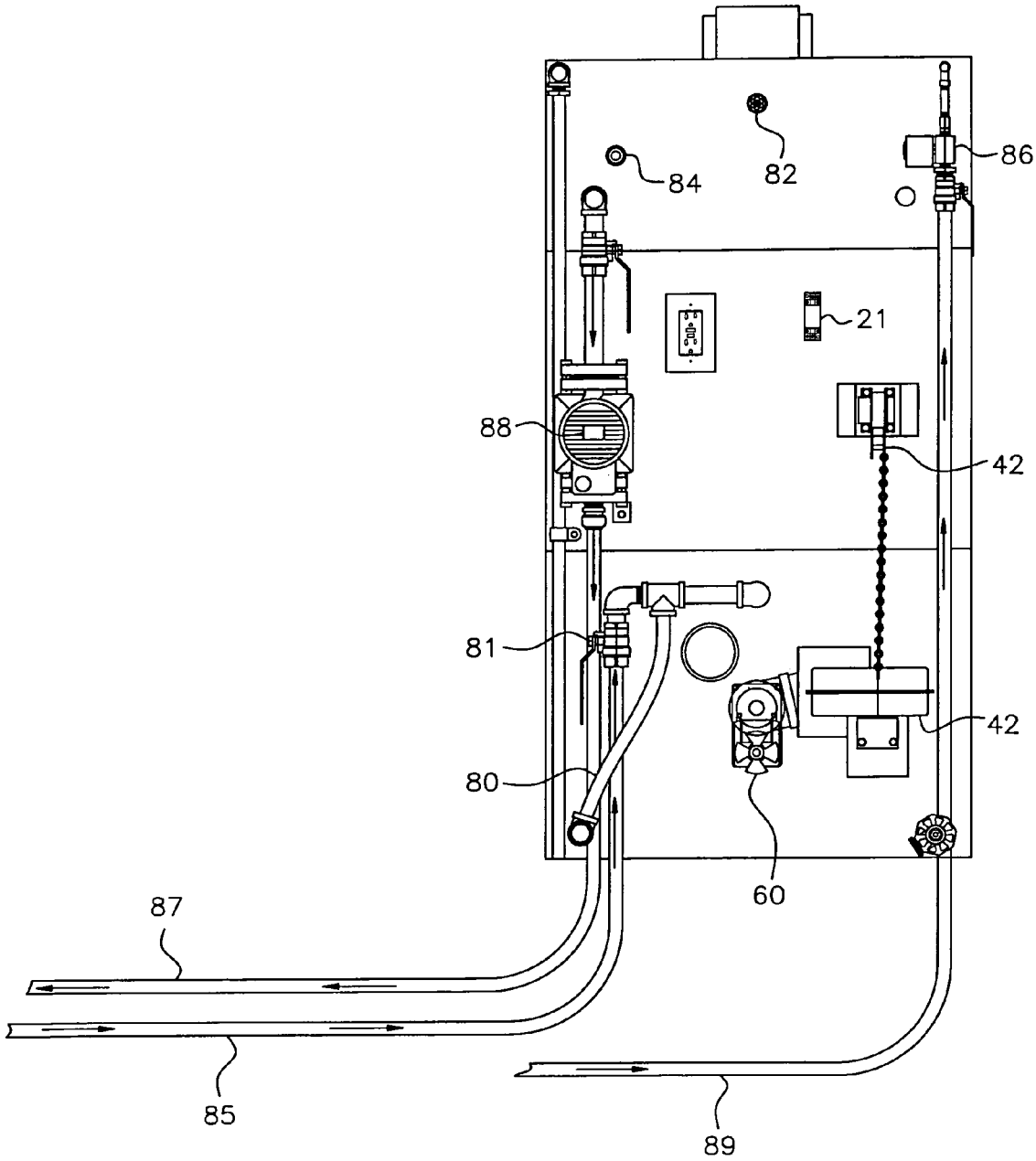
FIG. 12A is a rear view of the heating unit as in FIG. 10, and further showing water transport piping and water flow direction.
Figure 12B:
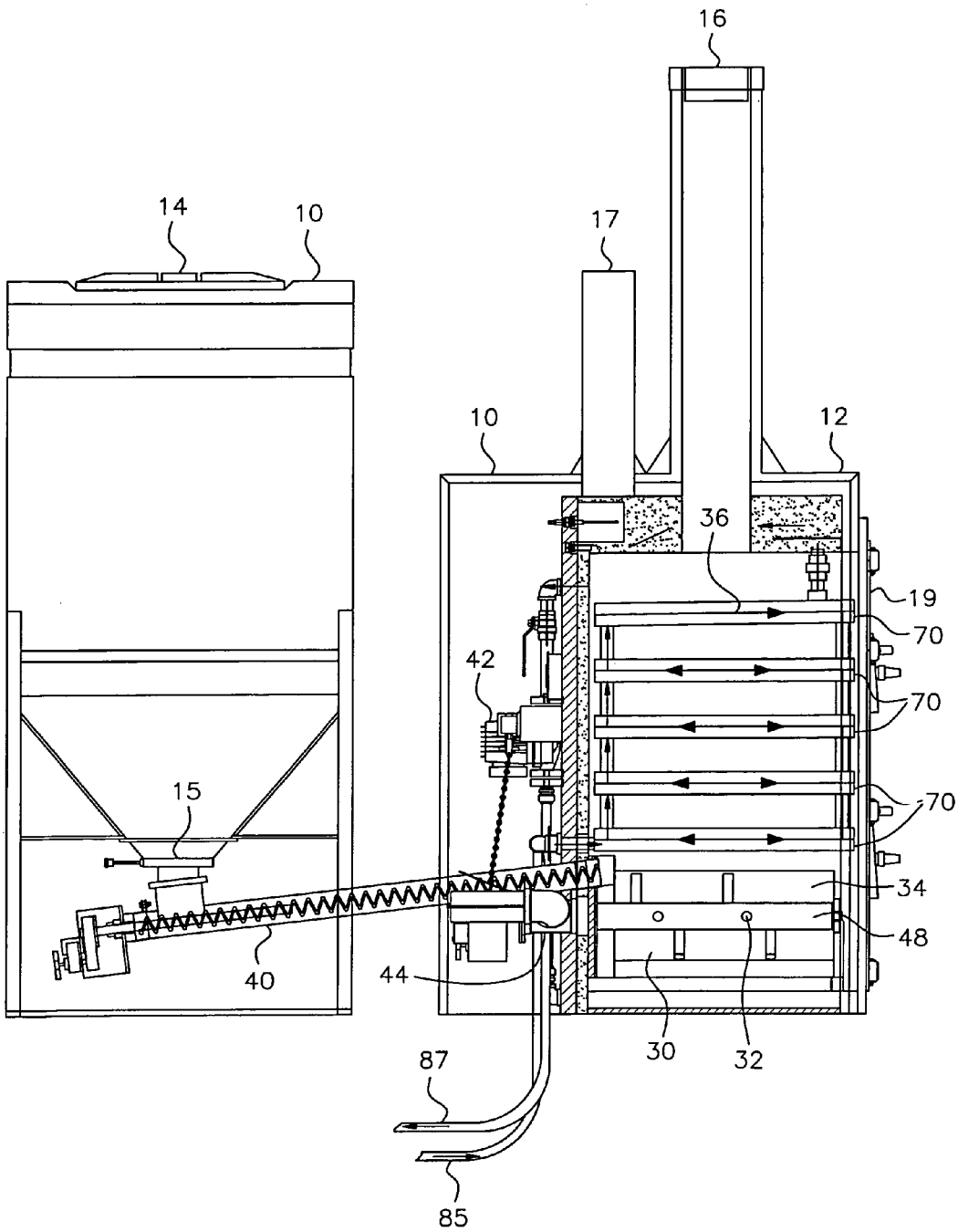
FIG. 12B is a cutaway side view of the heating unit and fuel storage bin as shown in FIG. 5, further showing the water flow direction through the heat/particulate recovery module.

More particularly, as shown in FIGS. 12A and 12B, during a power interruption hot water rises from the coldest bottom portion of the water tank and is then fed through the thermo cycle plumbing assembly 80 and water return 81 to the heat/particulate recovery module 36. The water moves upwardly through the module 36 from the lowermost recovery plate 71 to the uppermost, and hottest, portion of the water tank 31. Rather than passing into the supply line 87 and to the heated location, however, the water continues to cycle through the heating unit, returning through the thermo cycle plumbing assembly 80 to the heat/particulate recovery module 36 in a circulating loop that prevents excessive heat buildup in a particular area that might damage the heating unit or create a safety concern. Once power is restored, the heated water is again pumped through the water supply line 87 to the heated location and then back to the heating unit through the water return line 85 as previously described.

The process control module 20 with process control relay 21 provides for automatic operation of the heating unit 12, being programmable to control both the rate at which augered fuel is fed into the firebox burn chamber 34 and the rate at which the combustion air is introduced into the firebox burn chamber 34 for optimum burning, efficiency, safety and ease of operation.

In addition, the control module 20 receives inputs from various sensors including a low water sensor 82 and a water tank temperature sensor 84. If the control module receives a signal from the low water sensor indicating that a low water condition exists in the water tank 31, for example, the control module will automatically lock out the feed auger assembly 40 and the combustion air blower assembly 42, and energize an automatic water fill valve 86 that is connected to the pressurized water fill line 89 to prevent overheating of the heating unit. Once the low water condition in the water tank 31 has been remedied, the control module returns the heating unit to normal operation.

The heating unit is designed to burn wood pellets or any of the variously known fuel pellets that are available on the market today. The heating unit may also be configured to burn bin run corn grain. These fuels are readily available, renewable energy sources which is an important consideration in reducing fossil fuel consumption as well as greenhouse gases. A further advantage of these renewable energy sources is that the composition and packaging of the fuel makes it convenient for the consumer to use.

The automatic process control system of the present invention provides the benefit of efficient, user-friendly operation, eliminating the need for the user to make manual adjustments while the unit is operating. In addition, the combustion chamber design provides a very high degree of heating efficiency as well as effective particulate recovery, resulting in reduced emissions which protects the environment. The heating unit is designed to meet the 2010 Environmental Protection Agency requirements for efficiency and emissions standards that apply to automatically fed bio-fuel outdoor heating appliances, as described in ASTM standard E2618 (ASTM E6.54.08 Standard Test Method for Measurement of Particulate Emissions and Heating Efficiency of Outdoor Solid Fueled-Fired Hydronic Heating Appliances).

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. An automatically controlled outdoor pelletized bio-fuel burning hydronic heating system comprising:

a heating unit including a combustion chamber configured to burn pelletized fuel;

a feeding component for feeding pelletized fuel to said combustion chamber;

a combustion air distribution assembly mounted in said combustion chamber for distributing combustion air into the chamber;

a heat recovery module mounted in said combustion chamber above the pelletized fuel being combusted and configured to absorb heat being generated by the burning of said pelletized fuel;

a safety mechanism for ensuring continued operation of said heat recovery module without overheating in case of power failure; and a process control module for automatically controlling a rate of fuel introduction and a rate of combustion air introduction into the combustion chamber for burning efficiency.

2. The heating system as set forth in claim 1, wherein said heat recovery module includes a plurality of liquid-filled heat recovery plates mounted vertically in spaced relationship within the combustion chamber.

3. The heating system as set forth in claim 1, further comprising a removable insulated firebox burn chamber in a bottom of said combustion chamber for providing a high temperature combustion atmosphere.

4. The heating system as set forth in claim 3, wherein said combustion air distribution assembly includes a stir shaft that extends along a length of the firebox burn chamber and that has a plurality of spaced orifices along its length through which said combustion air is blown.

5. The heating system as set forth in claim 4, further comprising a combustion air blower assembly that directs a flow of air into a combustion air/power transmission device coupled to the combustion air distribution assembly.

6. The heating system as set forth in claim 5, further comprising a stir shaft drive assembly attached to the combustion air/power transmission device for rotating the stir shaft within the firebox burn chamber so that the combustion air being blown into the burn chamber through the stir shaft orifices is distributed throughout the firebox burn chamber to provide complete combustion of the fuel.

7. The heating system as set forth in claim 4, wherein said stir shaft is removable.

8. The heating system as set forth in claim 1, wherein said safety mechanism includes a thermo cycle plumbing assembly.

9. The heating system as set forth in claim 1, wherein said feeding component is a fuel auger for conveying fuel from a collection bin to said combustion chamber, said fuel auger being controlled by said process control module.

10. An automatically controlled outdoor pelletized bio-fuel burning hydronic heating system comprising:

a heating unit including a combustion chamber with an insulated firebox for burning pelletized fuel;

a feeding component for feeding pelletized fuel into said combustion chamber;

a combustion air distribution assembly mounted in said firebox for distributing combustion air throughout the chamber;

a heat/particulate recovery module mounted above said firebox in said combustion chamber to absorb heat being generated by the burning of said pelletized fuel and to recover particulates in exhaust generated by said burning;

a safety mechanism for ensuring continued operation of said heat/particulate recovery module without overheating in case of power failure; and a process control module for automatically controlling a rate at which fuel and the combustion air are introduced into the firebox for burning efficiency.

11. The heating system as set forth in claim 10, wherein said heat recovery module includes a plurality of liquid-filled heat recovery plates mounted vertically in spaced relationship within the combustion chamber and above the firebox.

12. The heating system as set forth in claim 10, wherein said combustion air distribution assembly includes a stir shaft that extends along a length of the firebox and that has a plurality of spaced orifices along its length through which said combustion air is blown.

13. The heating system as set forth in claim 12, further comprising a combustion air blower assembly that directs a flow of air into a combustion air/power transmission device coupled to the combustion air distribution assembly.

14. The heating system as set forth in claim 13, further comprising a stir shaft drive assembly attached to the combustion air/power transmission device for rotating the stir shaft within the firebox so that the combustion air being blown into the chamber through the stir shaft orifices is distributed throughout the chamber to provide complete combustion of the fuel.

15. The heating system as set forth in claim 10, wherein said safety mechanism includes a thermo cycle plumbing assembly.

16. The heating system as set forth in claim 10, wherein said firebox is removable.

17. The heating system as set forth in claim 10, wherein said stir shaft is removable.

18. The heating system as set forth in claim 10, wherein said feeding component includes a fuel auger for conveying fuel from a collection bin to said combustion chamber, said fuel auger being controlled by said process control module.

* * * * *